US010086306B2

(12) United States Patent
Louca et al.

(10) Patent No.: US 10,086,306 B2
(45) Date of Patent: Oct. 2, 2018

(54) TOY VEHICLE TRACK TRANSFER STATION

(71) Applicant: Mattel, Inc., El Segundo, CA (US)

(72) Inventors: Andreas Louca, Randoph, NJ (US); Matthew Lentini, Astoria, NY (US)

(73) Assignee: Mattel, Inc., El Segundo, CA (US)

( * ) Notice: Subject to any disclaimer, the term of this patent is extended or adjusted under 35 U.S.C. 154(b) by 155 days.

(21) Appl. No.: 14/920,016

(22) Filed: Oct. 22, 2015

(65) Prior Publication Data

US 2017/0113155 A1 Apr. 27, 2017

(51) Int. Cl.

*A63H 18/02* (2006.01)
*A63H 17/14* (2006.01)
*A63H 18/08* (2006.01)

(52) U.S. Cl.

CPC ..... *A63H 18/025* (2013.01); *A63H 17/14* (2013.01); *A63H 18/08* (2013.01)

(58) Field of Classification Search

CPC ..... A63H 18/00; A63H 18/02; A63H 18/023; A63H 18/025; A63H 19/00; A63H 19/02; A63H 19/04

See application file for complete search history.

(56) References Cited

U.S. PATENT DOCUMENTS 1,472,783 A 11/1923 Bauer
4,068,402 A * 1/1978 Tanaka ..... A63H 18/14 446/445
4,128,964 A 12/1978 Ogasawara
4,312,149 A 1/1982 Lwao
4,609,363 A 9/1986 Udagawa
4,662,283 A 5/1987 Chang
4,708,685 A 11/1987 Udagawa
5,174,569 A 12/1992 Ngai
5,643,040 A 7/1997 Hippely et al.
5,855,501 A 1/1999 Kato et al.
7,549,906 B2 6/2009 Bedford et al.
7,914,361 B1 3/2011 Morris et al.
8,162,716 B2 4/2012 Nuttall
8,342,903 B2 1/2013 O'Connor et al.
8,567,690 B2 10/2013 De La Torre
2005/0287919 A1 12/2005 Sheltman et al.

* cited by examiner

*Primary Examiner* — Robert J McCarry, Jr.
(74) *Attorney, Agent, or Firm* — Edell, Shapiro & Finnan, LLC

(57) ABSTRACT

An improved toy vehicle transfer station playset is disclosed herein. The playset includes a support frame that extends upwardly from a support surface. Coupled to the support frame is a slide rail having a first end and a second end. The first end is disposed higher than the second end with respect to the support surface. A carrier is movably coupled to the slide rail, and is configured to move along the slide rail from a first position proximate the first end to a second position proximate the second end of the slide rail via gravity. The carrier includes a track section for receiving a toy vehicle. The playset also includes a retaining mechanism disposed on the slide rail and configured to retain the carrier in the first position. However, when a toy vehicle is disposed on the track section of the carrier, the retaining mechanism releases the carrier to move along the slide rail to the second position.

20 Claims, 14 Drawing Sheets

TOY VEHICLE TRACK TRANSFER STATION

FIELD OF THE INVENTION

The present invention relates to a toy vehicle track playset. More specifically, the invention relates to a transfer station that may form part of the toy vehicle track playset, where the transfer station transfers a toy vehicle from a first track portion to a second track portion when the transfer station receives the toy vehicle.

BACKGROUND OF THE INVENTION

Current toy vehicle track playsets often include a continuous single track, where the toy vehicle is configured to travel along the track without being diverted. In other toy vehicle track sets, the track sets may have several different track portions that a toy vehicle may travel along, where the track portions are configured to intersect one another. These track portions often include track diverters that enable the user to divert the toy vehicle down one track portion or another track portion. However, over time, the entertainment value of these conventional track playsets and diverters decreases. In addition, toy vehicles are limited to transferring from one track portion to another track portion only when the track portions are configured to intersect one another. This limits the number of configurations of the track playset.

It would be desirable to provide toy vehicle track transfer station that enables a toy vehicle to transfer from one track portion to another track portion when the two track portions are substantially parallel to one another and/or do not intersect one another at the transfer location. Moreover, it would be desirable for a toy vehicle transfer station to dynamically transfer a toy vehicle from one track portion to another track portion so that the transfer station provides additional entertainment value to the toy vehicle track playset. It would also be desirable to provide a toy vehicle transfer station that is easy and inexpensive to manufacture.

SUMMARY OF THE INVENTION

An improved toy vehicle track playset configured to transfer a toy vehicle from one track to another according to the present invention includes a support frame, a rail, a carrier, and a retaining mechanism. The support frame extends substantially upward from a support surface. The rail may include a first end and a second end, and may be coupled to the support frame such that the first end is disposed at a first height and the second end is disposed at a second height. The carrier may be translatably coupled to the rail to move between a first position and a second position via the force of gravity. The carrier, in the first position, is disposed on the rail proximate to the first end, while the carrier, in the second position, is disposed on the rail proximate to the second end. The carrier further includes a track section that hangs below the rail. The retaining mechanism may be disposed on the rail such that the retaining mechanism retains the carrier in the first position. However, when a toy vehicle is disposed on the track section of the carrier, the retaining mechanism releases the carrier from the first position, enabling the carrier to travel along the rail to the second position.

In addition, this embodiment of the present invention may further include the support frame being disposed proximate to a first track and a second track. Moreover, the carrier may be disposed proximate to the first track when in the first position, and may be disposed proximate to the second track when in the second position. The track section of the carrier may be configured to receive a toy vehicle from the first track when the carrier is in the first position. The track section may also be configured to release the toy vehicle to the second track when the carrier is in the second position. The track section of the carrier may be configured to retain a toy vehicle thereon via at least one opening sized and shaped to receive and retain a wheel of the toy vehicle. Thus, the opening prevents the wheel of the toy vehicle from rotating along the track section of the carrier to stop the movement of the toy vehicle along the track section of the carrier.

The track section of the carrier may further comprise an engagement member that is movably coupled to the track section. The engagement member including at least one protrusion aligned with the at least one opening of the track section such that the engagement member may move with respect to the track section to move the protrusion into the opening of the track section. At the same time, the protrusion pushes the wheel of the toy vehicle out of the opening to enable the toy vehicle to continue traveling along the track section of the carrier. The protrusion of the engagement member is disposed into the at least one opening of the track section of the carrier when the carrier is in the second position, and the at least one protrusion of the engagement member is not disposed in the at least one opening of the track section of the carrier when the carrier is in the first position.

Another embodiment of an improved toy vehicle playset configured to transfer a toy vehicle from one track to another includes a support frame, a rail, a carrier, and a retaining mechanism. The support frame may be configured to extend upwardly from a support surface. The rail may include a first end and a second end. The rail may also be disposed on the support frame such that the first end is disposed at a first height and the second end is disposed at a second height, where the first height is greater than the second height. Thus, the first end of the rail is disposed higher with respect to a support surface than the second end of the rail. The carrier may be movably coupled to the rail, where the carrier is configured to translate between a first position and a second position. The carrier, in the first position, is disposed proximate to the first end and the carrier, in the second position, is disposed proximate to the second end. The carrier is configured to move from the first position to the second position along the rail via the force of gravity. Moreover, the retaining mechanism is disposed on the rail. The retaining mechanism is configured to prevent the carrier from moving out of the first position. However, when the carrier receives a toy vehicle on the track section of the carrier, the weight of the carrier combined with the weight of the toy vehicle causes the retaining mechanism to release the carrier from the first position, enabling it to translate along the rail to the second position.

In addition, in accordance with this embodiment of the present invention, the retaining mechanism may include a movable member with a protrusion. The movable member being configured to move between a retaining position and an open position, where the protrusion of the movable member prevents the carrier from translating along the rail when the movable member is in the retaining position. In addition, retaining mechanism may further includes a resilient member coupled to the movable member, the resilient member being configured to impart a biasing force onto the movable member to bias the movable member into the retaining position. The biasing force is tuned so that the weight of the carrier combined with weight of the toy vehicle overcomes the biasing force of the resilient member. Once the biasing force has been overcome, the movable member may be repositioned from the retaining position to the open position.

Furthermore, the rail includes a track that extends from the first end to the second end. The protrusion of the movable member may be configured to extend into the track of the rail proximate to the first end when the movable member is in the retaining position. The carrier may further include a wheel, sized and shaped to be received by the track of the rail, wherein rotation of the wheel along the track of the rail translates the carrier along the rail. Moreover, the track of the rail includes a cavity disposed on the track proximate to the second end of the rail. The cavity is sized and shaped to receive the wheel of the carrier, which stops the movement of the carrier along the rail at the second position.

A third embodiment of an improved toy vehicle playset configured to transfer a toy vehicle from one track to another includes a support frame, a rail, a carrier, and a retaining mechanism. The support frame may extend substantially upwardly from a support surface. Moreover, the rail may include a first end and a second end. The rail may be disposed on the support frame at an angle offset from a horizontal axis such that the first end is oriented higher than the second end. In other words, the first end is oriented higher above, or farther away, from the support surface than the second end of the rail. The carrier, which may include a platform coupled to the bottom of the carrier, may be movably coupled to the rail. The carrier may be configured to translate between a first position and a second position. In the first position, the carrier may be disposed on the rail proximate the first end. Conversely, in the second position, the carrier may be disposed on the rail proximate to the second end. The retaining mechanism may include a retaining arm and a resilient member. The retaining mechanism may be coupled to the rail proximate to the first end of the rail. The retaining arm may be repositionable between a retaining position and an open position. When the retaining arm is in the retaining position, the retaining arm retains the carrier in the first position. The retaining mechanism may further include a resilient member that is coupled to the retaining arm. The resilient member may impart a biasing force on the retaining arm, where the biasing force biases the retaining arm to the retaining position. Furthermore, once the carrier receives a toy vehicle on the platform, the weight of the carrier combined with weight of the toy vehicle is able to overcome the biasing force of the resilient member. Thus, the carrier with a toy vehicle is configured to move the retaining arm to the open position, enabling the carrier to translate down the rail from the first position to the second position.

In addition, in accordance with this third embodiment, the rail includes a track that extends from the first end to the second end. The retaining arm of the retaining mechanism includes a protrusion that is configured to extend into the track of the rail when the retaining arm is in the retaining position. Furthermore, the carrier may include a wheel, sized and shaped to rotate along the track of the rail. Moreover, when the retaining arm is in the retaining position, the protrusion of the retaining arm engages the wheel of the carrier to prevent the wheel from rotating along the track.

In addition, the support frame may be disposed proximate to a first track and a second track so that the platform of the carrier is disposed over and in alignment with the first track when the carrier is in the first position. Furthermore, the platform of the carrier is disposed in alignment with the second track when in the second position. The carrier may be configured to receive the toy vehicle from the first track when the carrier is in the first position and then release the toy vehicle onto the second track when the carrier is in the second position.

BRIEF DESCRIPTION OF THE DRAWINGS

Like reference numerals have been used to identify like elements throughout this disclosure.

DETAILED DESCRIPTION OF THE INVENTION

The present invention disclosed herein is a transfer station for a toy vehicle track playset. The transfer station is configured to be coupled to track portions of the toy vehicle track playset, where a toy vehicle either passes through the transfer station or is transferred from one track portion to another track portion. More specifically, the transfer station includes a carrier that is slidably coupled to a slide rail between an outer position and an inner position. The transfer station may be coupled to an outer track portion and an inner track portion, where the inner track portion may or may not merge into the outer track portion at a location on the outer track portion that is disposed away from the transfer station.

When the carrier is in the inner position, a toy vehicle may travel unimpeded along the outer track portion and through the transfer station to continue along the outer track portion. However, when the carrier is in the outer position, a toy vehicle traveling along the outer track portion will enter the carrier, where the combination of the carrier and the toy vehicle will cause the carrier to be dislodged from its outer position. The carrier may then slide down and along the slide rail to its inner position, where the toy vehicle will be permitted to exit the carrier onto the inner track portion.

Figure 1:
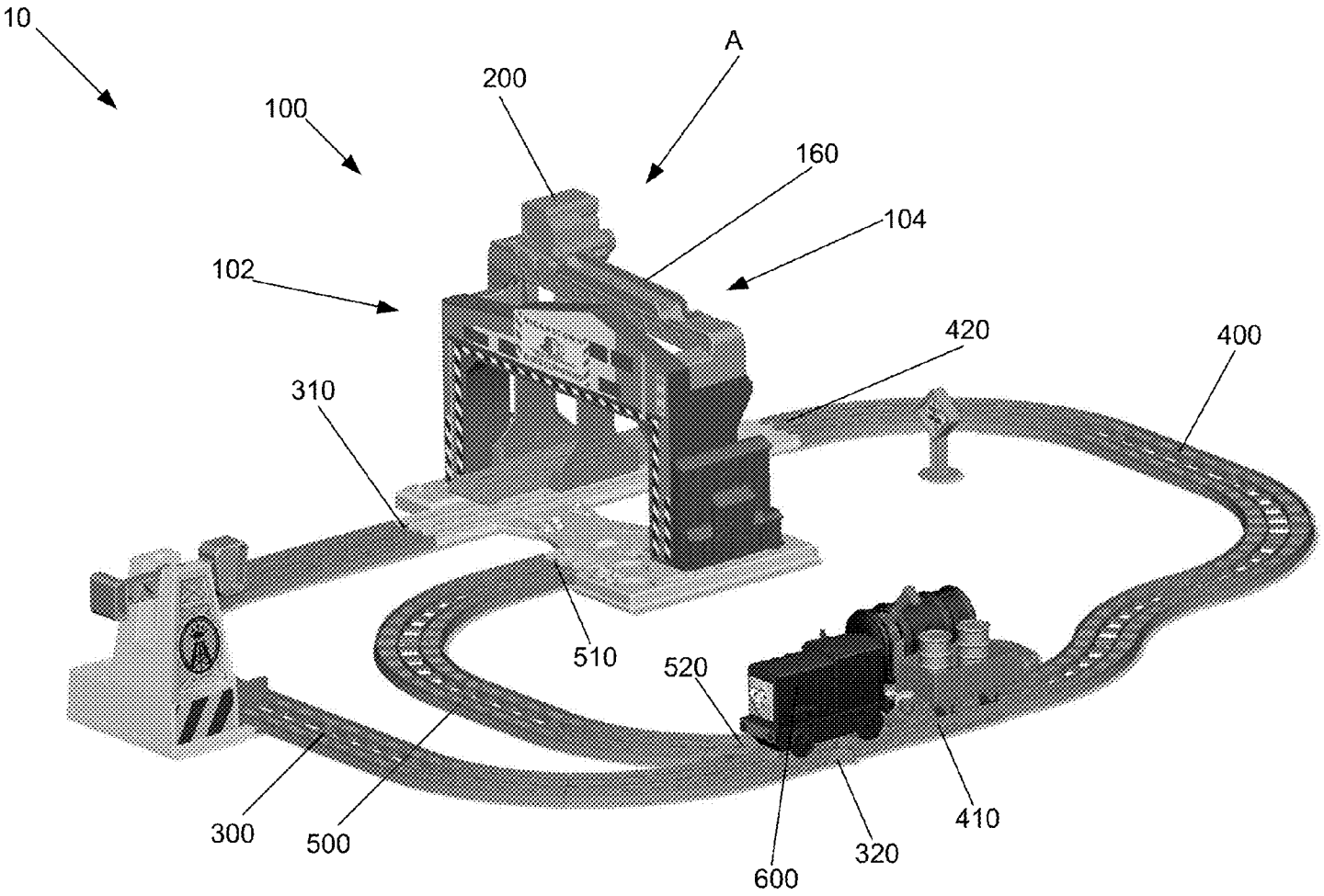
FIG. 1 illustrates a perspective view of an embodiment of toy vehicle track playset that includes a track transfer station according to the present invention.

Turning to FIG. 1, illustrated is a perspective view of a toy vehicle track playset 10. The toy vehicle track playset 10 includes a transfer station 100, a first outer track 300, a second outer track 400, and an inner track 500. As illustrated, the first outer track 300 includes a proximal end 310 and a distal end 320. Similarly, the second outer track 400 includes a proximal end 410 and a distal end 420, while the inner track 500 also includes a proximal end 510 and a distal end 520. The transfer station 100 includes a front side 102 and a rear side 104. As illustrated, the proximal end 310 of the first outer track 300 and the proximal end 510 of the inner track 500 are coupled to and extend substantially outwardly from the front side 102 of the transfer station 100. Moreover, the distal end 320 of the first outer track 300 is coupled to the distal end 520 of the inner track 500. As further illustrated, the proximal end 410 of the second outer track 400 is coupled to the coupling of the distal ends 520, 320 of the inner and first outer tracks 500, 300. Thus, the first outer track 300 and the inner track 500 merge together into the second outer track 400. The distal end 420 of the second outer track 400 is coupled to the rear side 104 of transfer station 100. The first outer track 300, second outer track 400, and inner track 500 are substantially curved so that when coupled to one another, the tracks 300, 400, 500 and the transfer station 100 form a substantially circular track playset 10.

Figure 2:
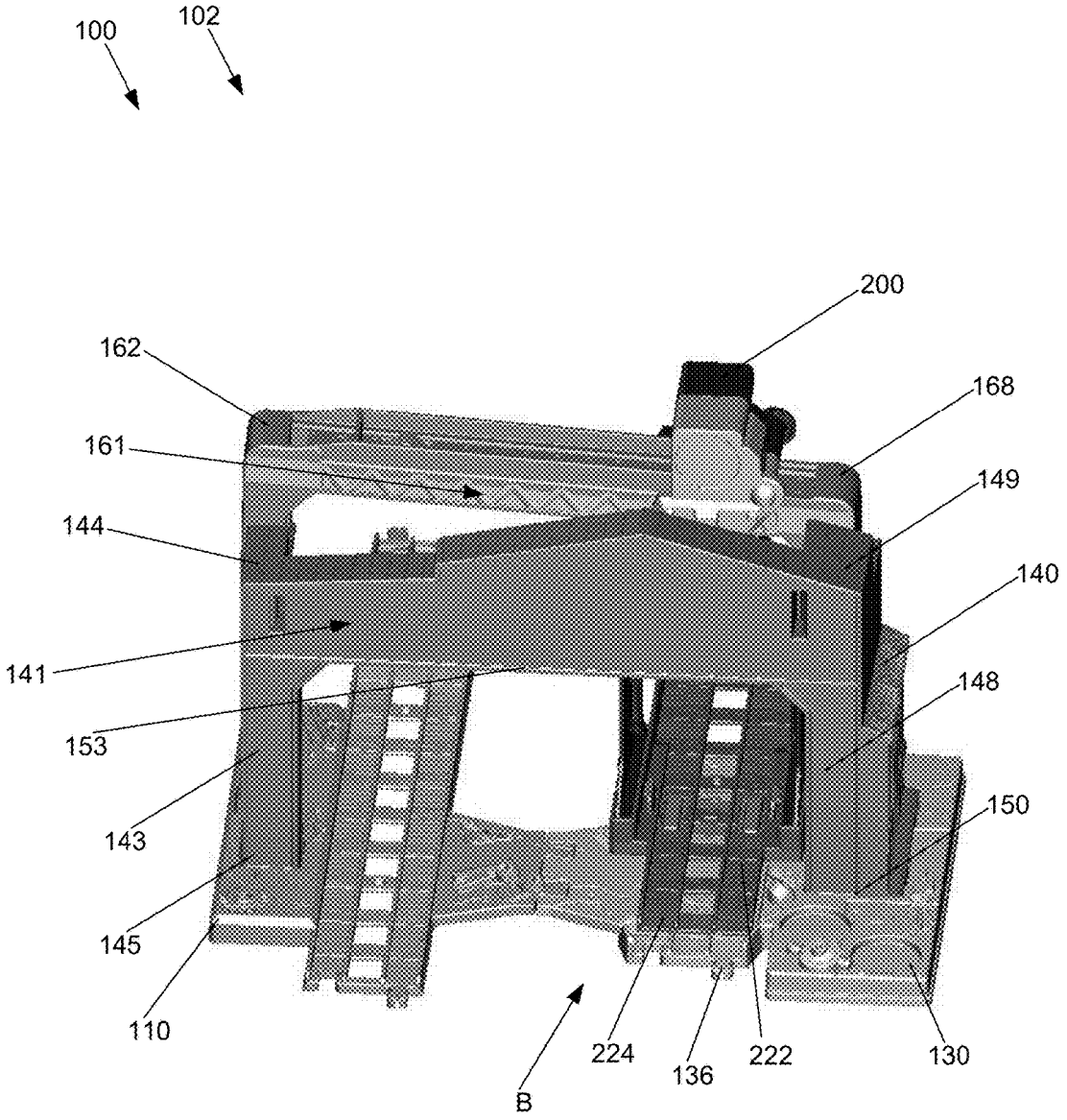
FIG. 2 illustrates a front perspective view of the embodiment of the track transfer station as illustrated in FIG. 1.
Figure 3:
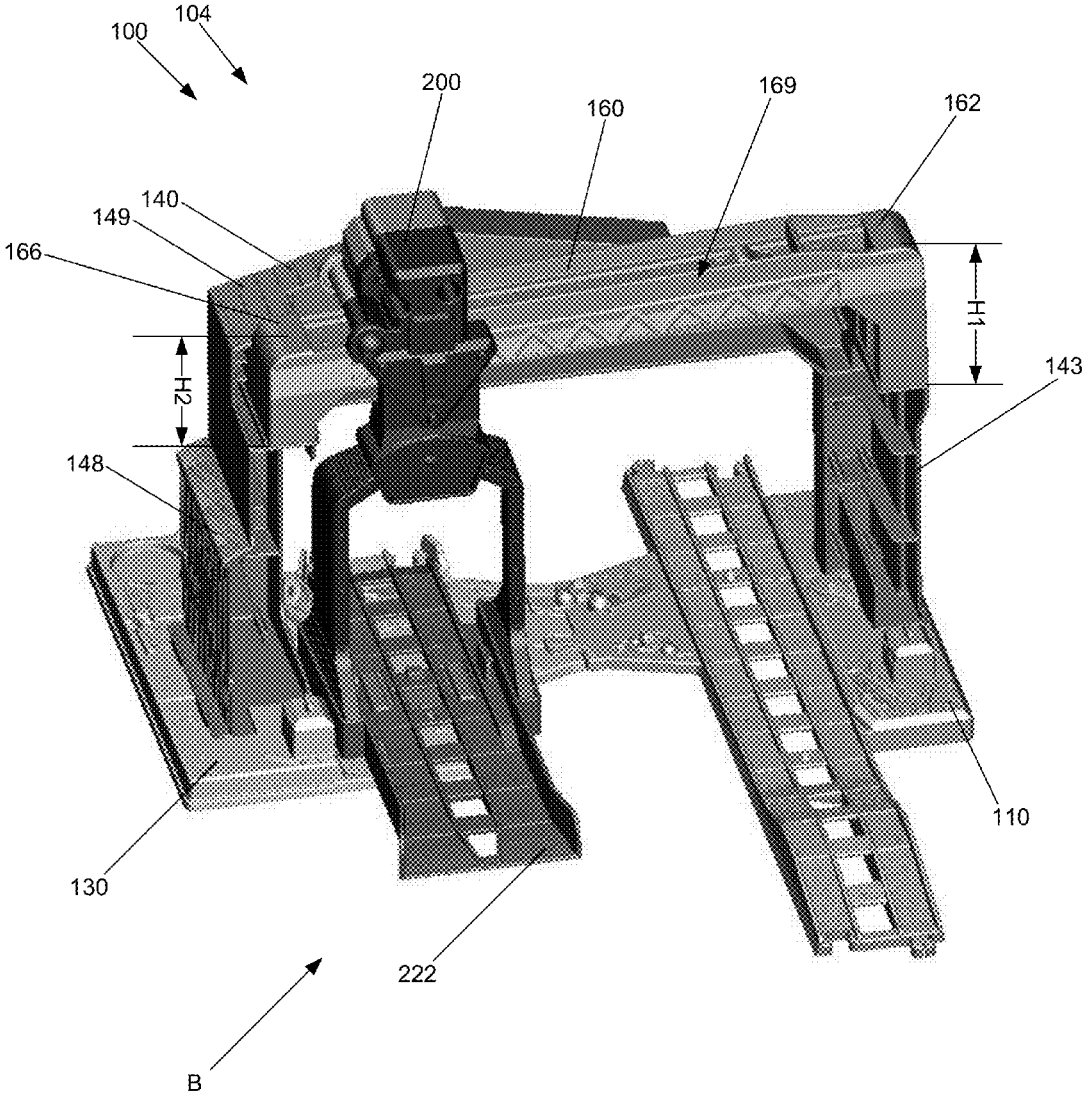
FIG. 3 illustrates a rear perspective view of the embodiment of the track transfer station as illustrated in FIG. 2.

Turning to FIGS. 2 and 3, illustrated is the transfer station 100. FIG. 2 illustrates a perspective view of the front side 102 of the transfer station 100, while FIG. 3 illustrates a perspective view of the rear side 104 of the transfer station 100. The transfer station 100 includes a first base member 110, a second base member 130, and a support structure 140 disposed on the first base member 110 and the second base member 130. Moreover, as best illustrated in FIG. 3, the transfer station 100 further includes a slide rail 160 that is disposed on the support structure 140. Slidably disposed on the slide rail 160 is a carrier 200 that contains a floating track portion 222.

Figure 4:
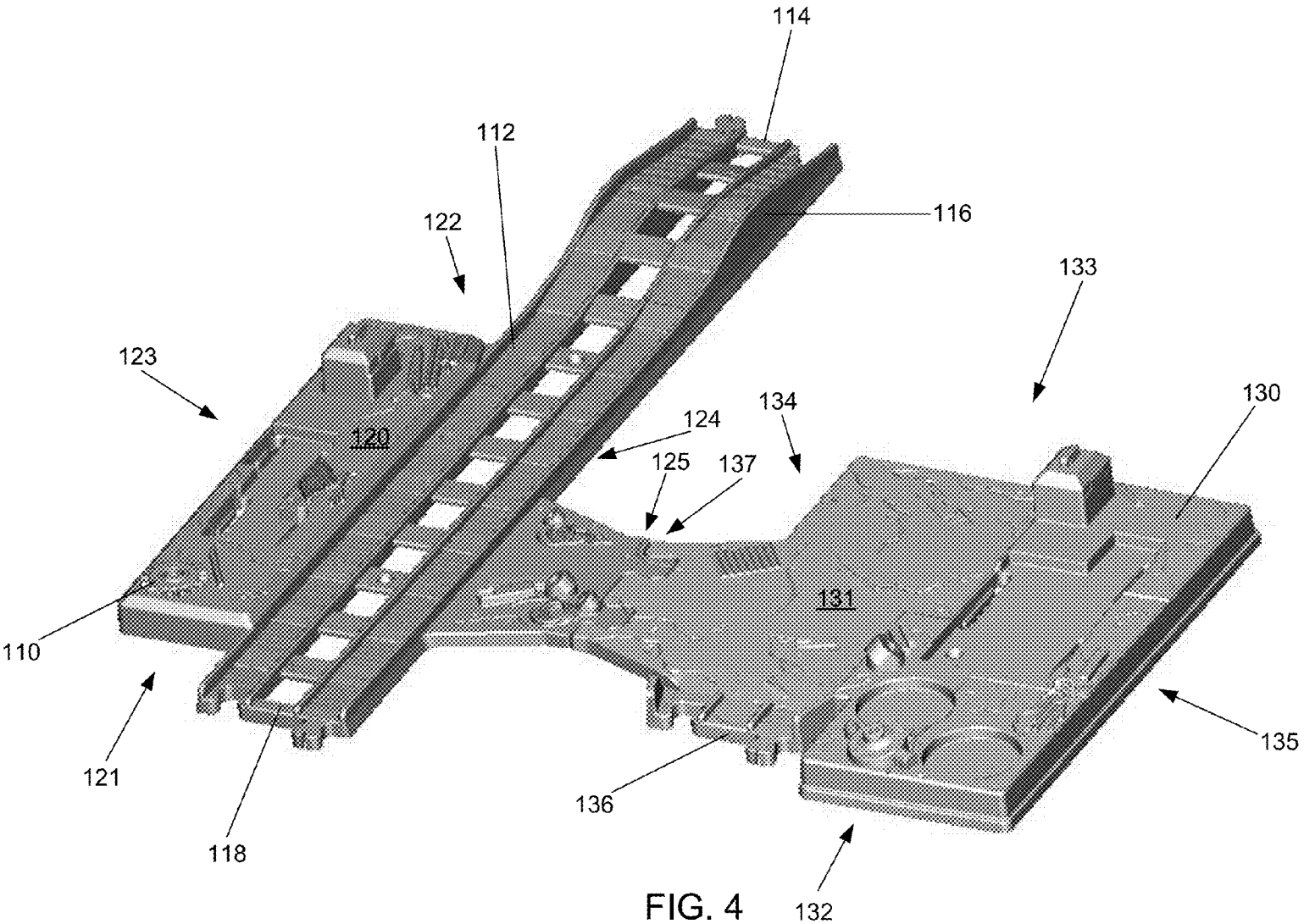
FIG. 4 illustrates a perspective view of the base the embodiment of the track transfer station illustrated in FIG. 2.

Illustrated in FIG. 4 is a perspective view of the first and second base members 110, 130. As illustrated, the first base member 110 contains a front side 121, a rear side 122 opposite the front side 121, a first side 123 that spans the distance between the front side 121 and the rear side 122, and a second side 124 disposed opposite the first side 123. Extending outwardly from the second side 124 is a connector 125. Moreover, the first base member 110 includes a top surface 120 and a bottom surface (not illustrated). A track portion 112 may be integrally formed within the first base member 110 and configured to extend through the front side 121 and the rear side 122 of the first base member 110. The track portion 112 includes a first end 114 that extends outwardly from the rear side 122 of the first base member 110. The track portion 112 further includes a second end 118 that extends outwardly from the front side 121 of the first base member 110. As further illustrated in FIG. 4, disposed in the track portion 112 proximate to the first end 114 is a ramp 116. The first end 114 of the track portion 112 is configured to be coupled to the second end 420 of the second outer track 400 as illustrated in FIG. 1. In addition, the second end 118 of the track portion 112 is configured to be coupled to the first end 310 of the first outer track portion 300 as illustrated in FIG. 1. In other embodiments, the first and second ends 114, 118 of the track portion 112 may be configured to be coupled to any end of other tracks.

The second base member 130 contains a front side 132, a rear side 133 opposite the front side 132, a first side 134 that spans the distance between the front side 132 and the rear side 133, and a second side 135 disposed opposite the first side 134. The second base member 130 further includes a top surface 131 and a bottom surface (not illustrated). Moreover, extending outwardly from the first side 134 is a connector 137 that is configured to be coupled to the connector 125 of the first base member 110. Thus, when the connector 125 of the first base member 110 is coupled to the connector 137 of the second base member 130, the first base member 110 is coupled to the second base member 130. The second base member 130 further includes a track end 136 that extends outwardly from the front side 132 of the second base member 130, the track end 136 being integrally formed in the second base member 130. The track end 136 is configured to be coupled to the first end 510 of the inner track 500, as illustrated in FIG. 1. In other embodiments, the track end 136 may be configured to be coupled to any end of other tracks.

Figure 5:
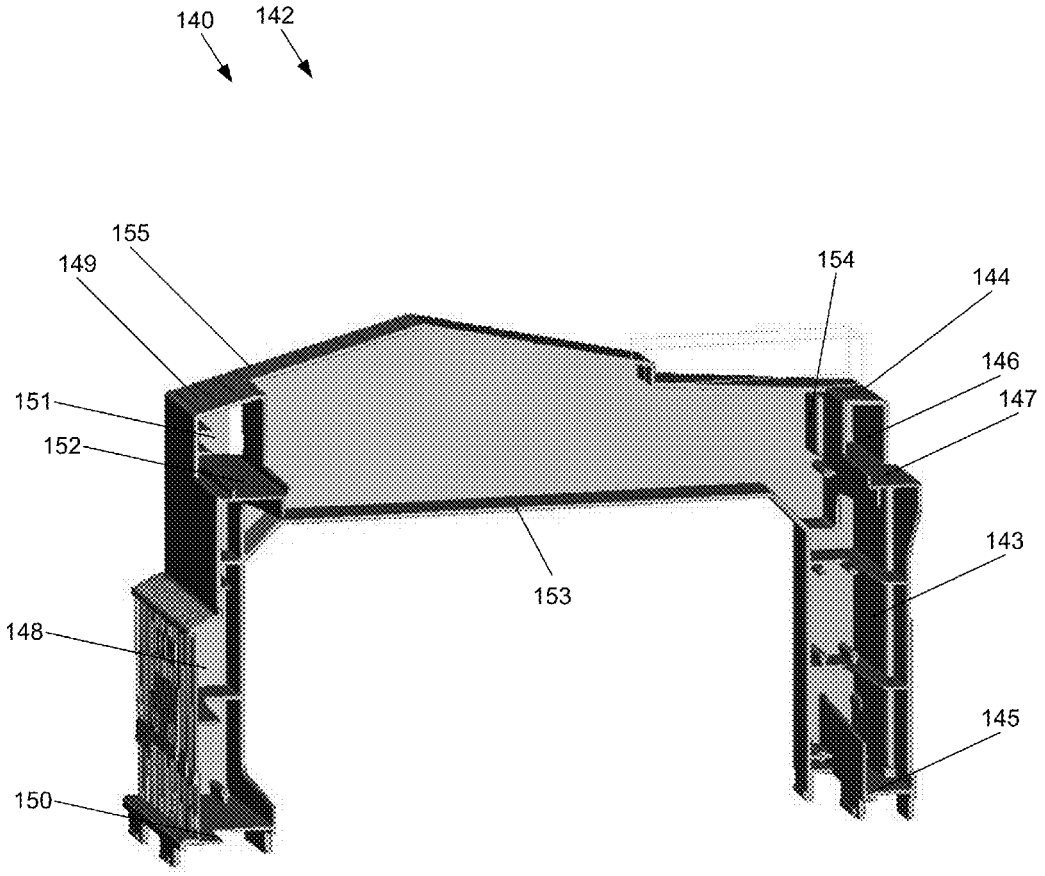
FIG. 5 illustrates a rear view of the support structure of the embodiment of the track transfer station illustrated in FIG. 2.

Turning to FIGS. 2 and 5, illustrated is a support structure 140. The front side 141 of the support structure 140 is illustrated in FIG. 2, while the rear side 142 of the support structure 140 is illustrated in FIG. 5. The support structure 140 includes a first support member 143, a second support member 148, and a cross support member 153. The first and second support members 143, 148 are disposed substantially vertically, while the cross support member 153 is disposed substantially horizontally. Moreover, the first support member 143 contains a first end 144, and a second end 145, while the second support member 148 also contains a first end 149 and a second end 150. As best illustrated in FIG. 2, the second end 145 of the first support member 143 is disposed on and coupled to the top surface 120 of the first base member 110. Similarly, the second end 150 of the second support member 148 is disposed on and coupled to the top surface 131 of the second base member 130. As best illustrated in FIG. 5, the cross support member 153 includes a proximal end 154 and a distal end 155 opposite the proximal end 154. The proximal end 154 of the cross support member 153 may be coupled to the first end 144 of the first support member 143, while the distal end 155 of the cross support member 153 may be coupled to the first end 149 of the second support member 148.

Further illustrated in FIG. 5, the first support member 143 contains a cavity 146 disposed proximate to the first end 144. The first support member 143 also contains a platform 147 that is disposed below the cavity 146. In addition, the second support member 148 contains a cavity 151 that is disposed proximate to the first end 149. Similar to the first support member 143, the second support member 148 also contains a platform 152 that is disposed directly below the cavity 151.

Figure 6:
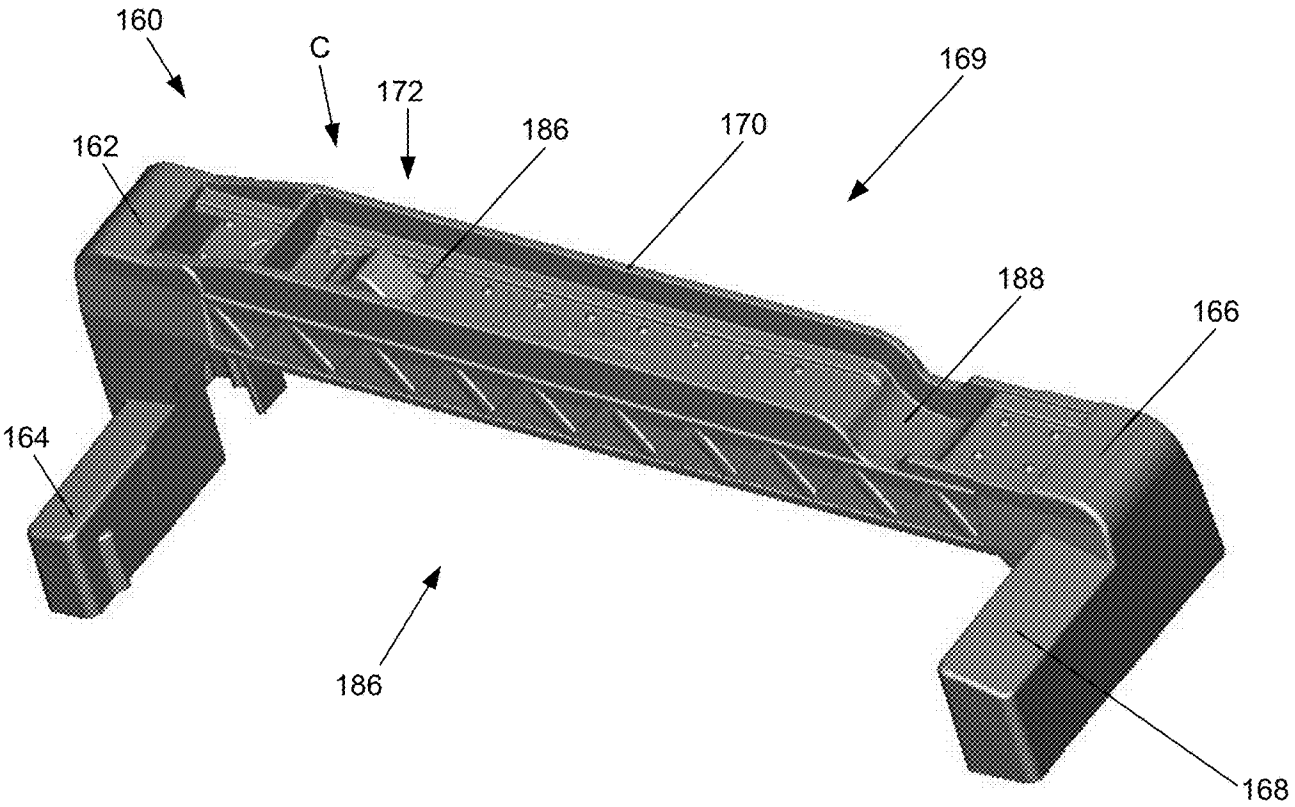
FIG. 6 illustrates a perspective view of the slide rail of the embodiment of the track transfer station illustrated in FIG. 2.
Figure 7:
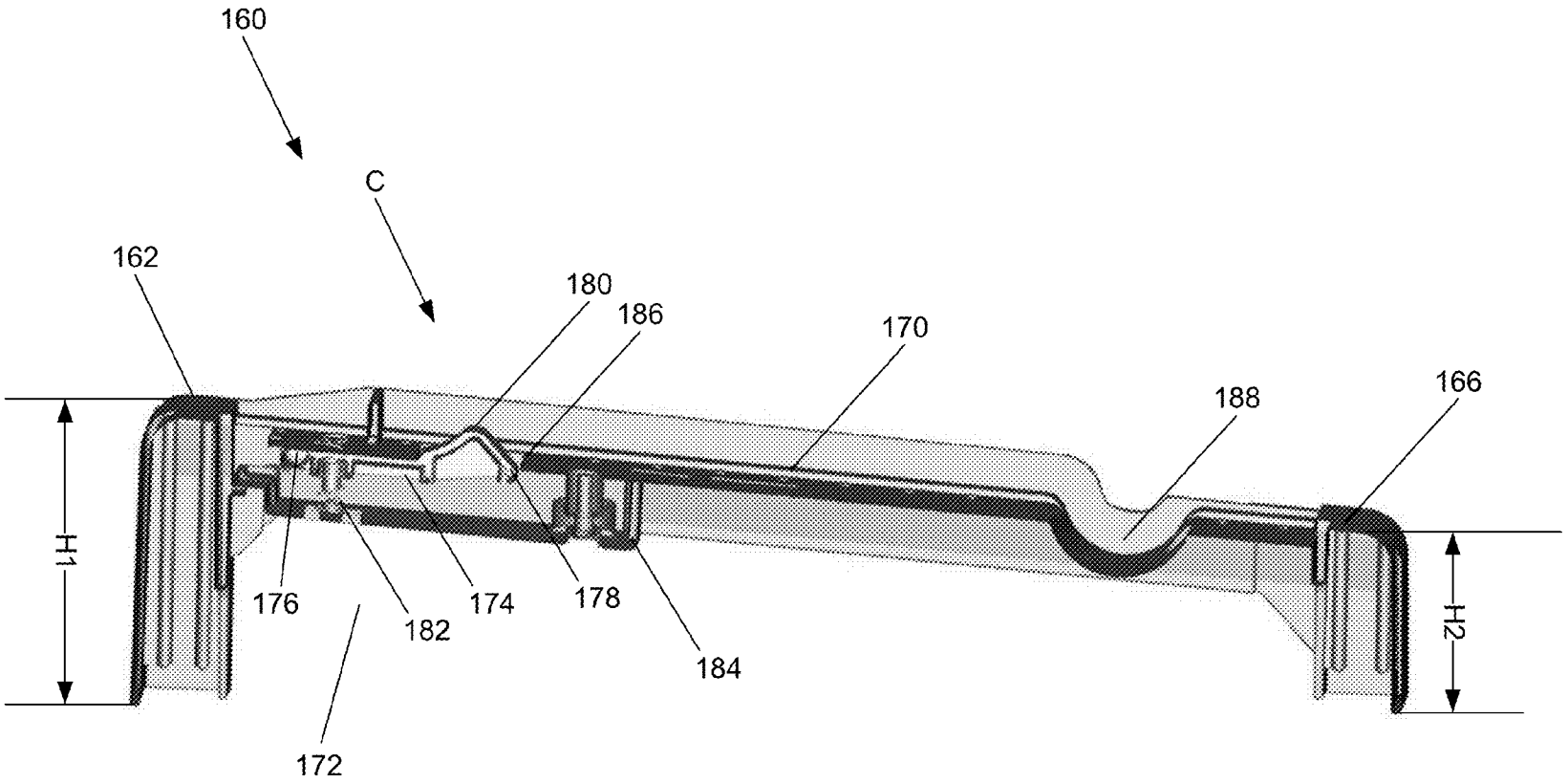
FIG. 7 illustrates a cross-sectional view of the slide rail illustrated in FIG. 6.

Referring to FIGS. 6 and 7, illustrated is the slide rail 160 of the transfer station 100. The slide rail 160 includes a front side 161 (see reference number in FIG. 2), a first end 162, a second end 166 disposed opposite the first end 162, and a rear side 169 disposed opposite of the front side 161. The slide rail 160 further includes a track 170 that spans from the first end 162 to the second end 166. The first end 162 contains a protrusion 164, where the protrusion 164 extends outwardly from the front side 161 of the slide rail 160. Similarly, the second end 166 also contains a protrusion 168 that extends outwardly from the front side 161 of the slide rail 160. The protrusions 164, 168 are configured to fit within the cavities 146, 151 of the support structure 140. Moreover, in one embodiment the protrusions 164, 168 may be configured to frictionally fit within the cavities 146, 151 of the support structure 140, while in another embodiment, the protrusions 164, 168 may be configured to snap into the cavities 146, 151 of the support structure 140.

As further illustrated in FIGS. 6 and 7, the slide rail 160 includes a retaining mechanism 172 disposed within the slide rail 160 proximate to the first end 162. The retaining mechanism 172 is disposed within the slide rail 160 and under the track 170. As illustrated in FIGS. 6 and 7, disposed within the track 170 proximate to the first end 162 of the slide rail 160 is an opening 186, and the retaining mechanism 172 is disposed proximate to the opening 186 such that at least a portion of the retaining mechanism extends through the opening 186. As further illustrated, the retaining mechanism 172 includes a retaining arm or movable member 174, a resilient member 182, and a cover 184. The cover 184 is coupled to the underside of the track 170 of the slide rail 160, and is configured to cover the movable member 174 and the resilient member 182, encasing them against the bottom side of the track 170. The movable member 174 includes a first end 176 and a second end 178. The second end 178 of the movable member includes a protrusion 180 that may extend through the opening 186 in the track 170. Moreover, the movable member 174 is configured to rotate about its first end 176, within the cover 184 and underneath the track 170, between a retaining position C (illustrated in FIGS. 6 and 7), and an open position (not illustrated). When the movable member 174 is in the retaining position C, the protrusion 180 extends through the opening 186 in the track 170. Conversely, when the movable member 174 is in the open position, the protrusion 180 does not extend through the opening 186 because the movable member 174 has been pivoted downward until the protrusion 180 is disposed beneath the track 170. The resilient member 182 may be configured to impart a biasing force onto the movable member 174 to bias the movable member 174 into the retaining position C.

As further illustrated in FIGS. 6 and 7, the track 170 also includes a cavity 188. The cavity 188 is disposed within the track 170 proximate to the second end 166. Thus, the cavity 188 is disposed in the track 170 proximate to the end of the track 170 that is opposite of the location of the retaining mechanism 172. As further illustrated, the cavity 188 is formed as a dip, indent, or depression in the track 170. The cavity 188 may also be formed as a break in the track 170. The cavity 188 is formed, shaped, and sized to stop the movement of an item traveling down on the track 170 from the retaining mechanism 172 toward end 166.

Returning to FIGS. 2 and 3, the slide rail 160 is configured to be coupled to the support structure 140. As previously explained, the protrusion 164 of the first end 162 of the slide rail 160 is configured to fit within the cavity 146 of the first support member 143 of the support structure 140. Moreover, the protrusion 168 of the second end 166 of the slide rail 160 is configured to fit within the cavity 151 of the second support member 148 of the support structure 140. When the protrusions 164, 168 of the slide rail 160 are disposed within the cavities 146, 151 of the support structure 140, the first end 162 of the slide rail 160 may rest on the platform 147 of the first support member 143, while the second end 166 of the slide rail 160 may rest on the platform 152 of the second support member 148. Furthermore, when the slide rail 160 is coupled to the support structure 140, the front side 161 of the slide rail 160 is disposed proximate to the rear side 142 of the support structure 140.

As best illustrated in FIGS. 3 and 7, the first end 162 and the second end 166 are disposed at different heights. The first end 162 is disposed at a first height H1, and the second end 166 is disposed at a second height H2, where the first height H1 is larger than the second height H2. Thus, the track 170 of the slide rail 160 is at an angle offset from a horizontal plane. In addition, the first end 162 is disposed higher above, and farther from the support surface than the second end 166. It then follows that objects placed on the track 170 slide or travel down the track 170 toward the second end 166 of the slide rail 160 via the force of gravity. Furthermore, the retaining mechanism 172, when in the retaining position C, retains object placed on the track 170 in proximity to the first end 162 of the slide rail 160. When in the retaining position C, the protrusion 180 on the movable member 174 of the retaining mechanism 172 extends through the opening 186 in the track 170 to engage and impede objects from sliding or traveling down the track 170 towards the second end 166 of the slide rail 160.

Figure 8:
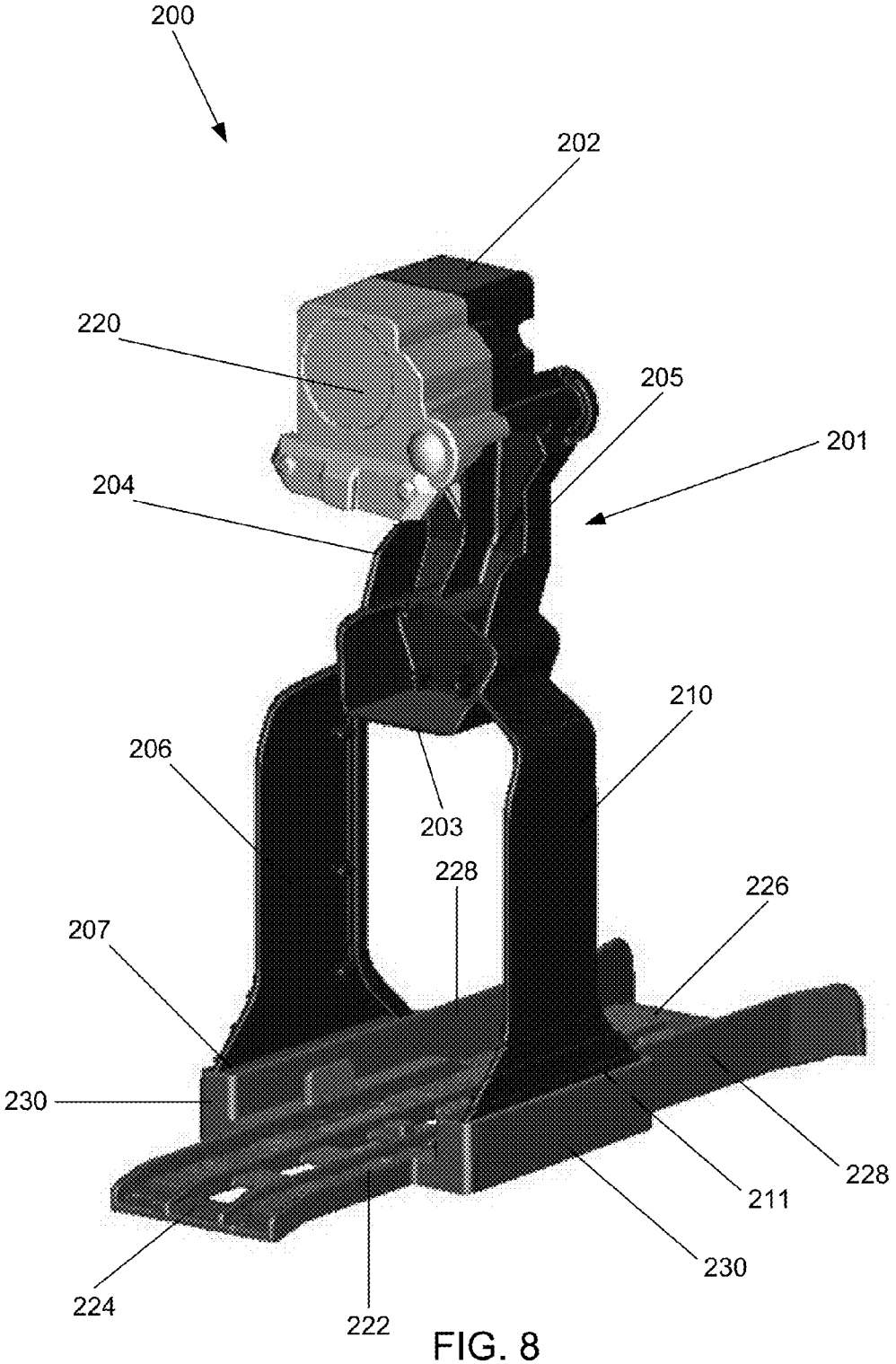
FIG. 8 illustrates a perspective view of a carrier of the embodiment of the track transfer station illustrated in FIG. 2.
Figure 9:
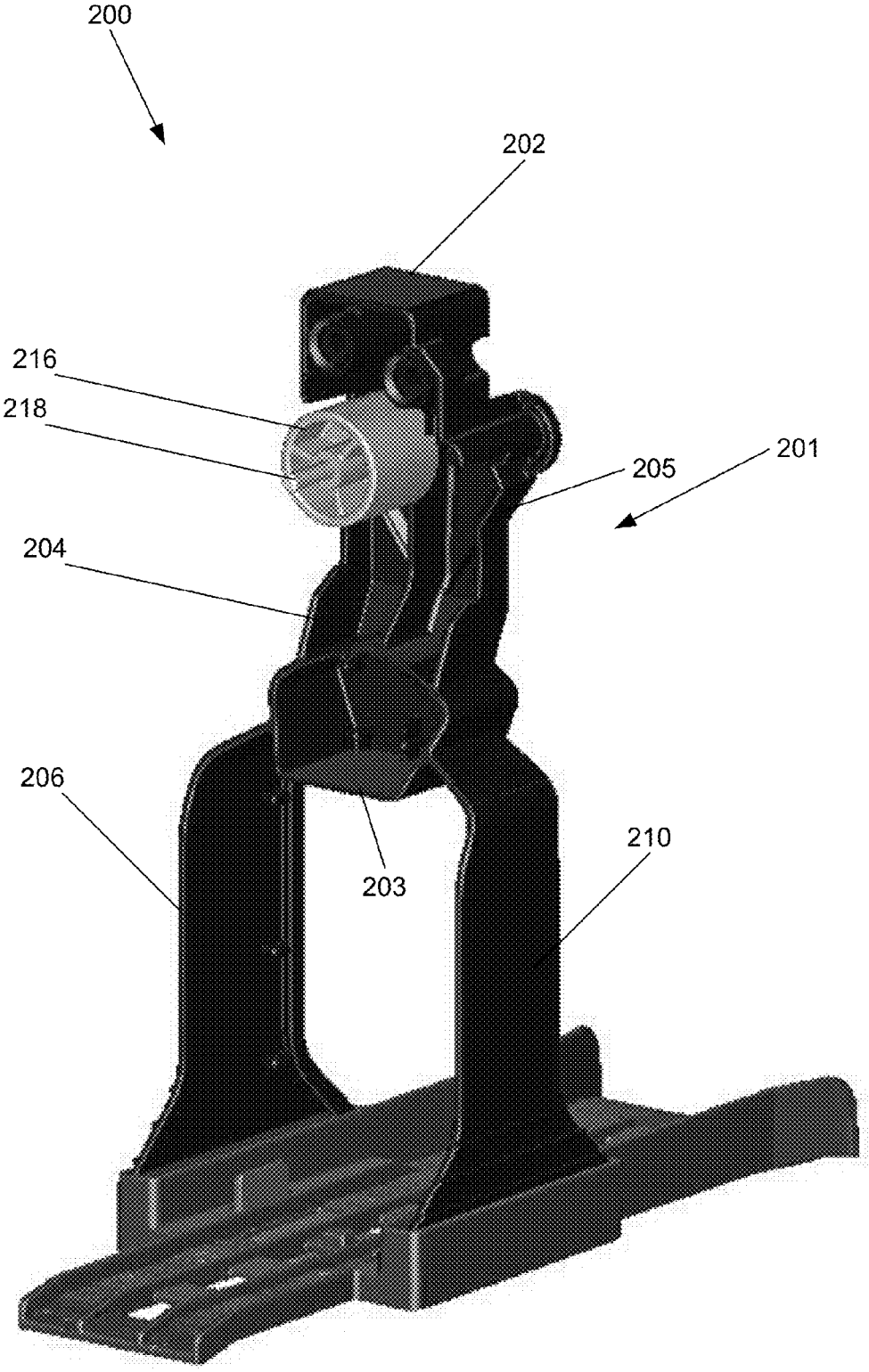
FIG. 9 illustrates a perspective view of the carrier illustrated in FIG. 8, the inner components of the sliding carrier being exposed.

Turning to FIGS. 8 and 9, illustrated is the carrier 200. The carrier 200 includes a hanger 201, which contains a top end 202, a bottom end 203 opposite the top end 202, a first side 204 spanning the distance between the top end 202 and the bottom end 203, and a second side 205 opposite the first side 204. The hanger 201 includes a first hanger arm 206 and a second hanger arm 210. The first hanger arm 206 extends substantially downwardly from the first side 204 and beyond the bottom end 203 of the hanger 201. Similarly, the second hanger arm 210 extends substantially downwardly from the second side 205 and beyond the bottom end 203 of the hanger 201. Thus, the hanger 201 with the two hanger arms 206, 210 may have the general shape that is similar to that of an inverted Y. Moreover, the first hanger arm 206 contains an end 207 and the second hanger arm 210 contains an end 211.

FIGS. 8 and 9 further illustrate that the hanger 201 of the carrier 200 includes a cover 220 proximate to the top end 202 of the hanger 201. Moreover, as best illustrated in FIG. 9, disposed under the cover 202 and coupled to the hanger 201 proximate to the top end 202 is an axle 218. Rotatably coupled to the axle 218 is a wheel 216. When the cover 220 is coupled to the hanger 201, a portion of the wheel 216 may be exposed and configured to contact the track 170 of the slide rail 160. Moreover, the wheel 216 is of a size and shape that enables the wheel 216 to rotate about its axle 218 along the track 170 of the slide rail 160.

Figure 10:
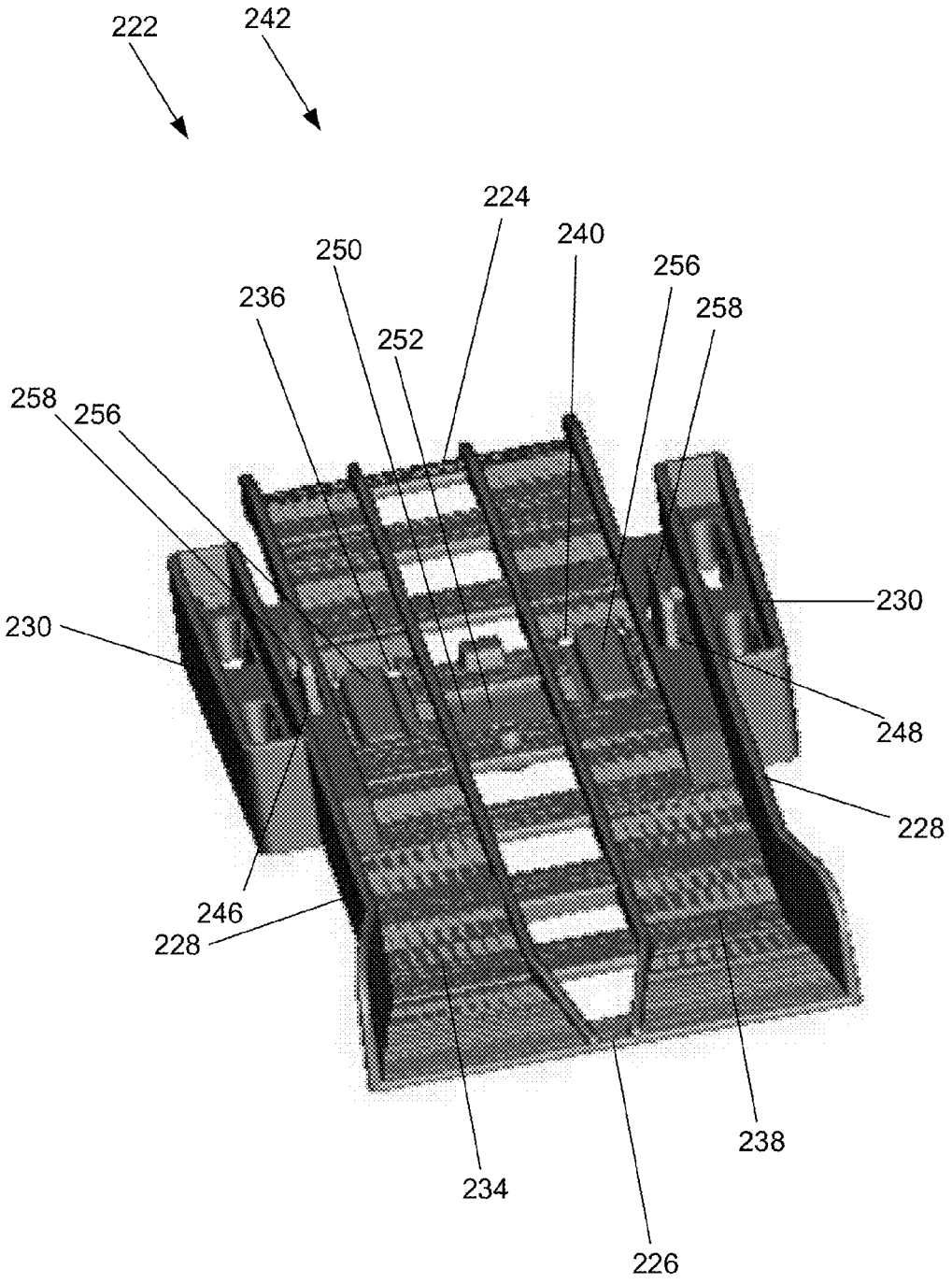
FIG. 10 illustrates a perspective view of the top of the track portion of the sliding carrier illustrated in FIG. 8, the track portion including the engagement member.
Figure 11:
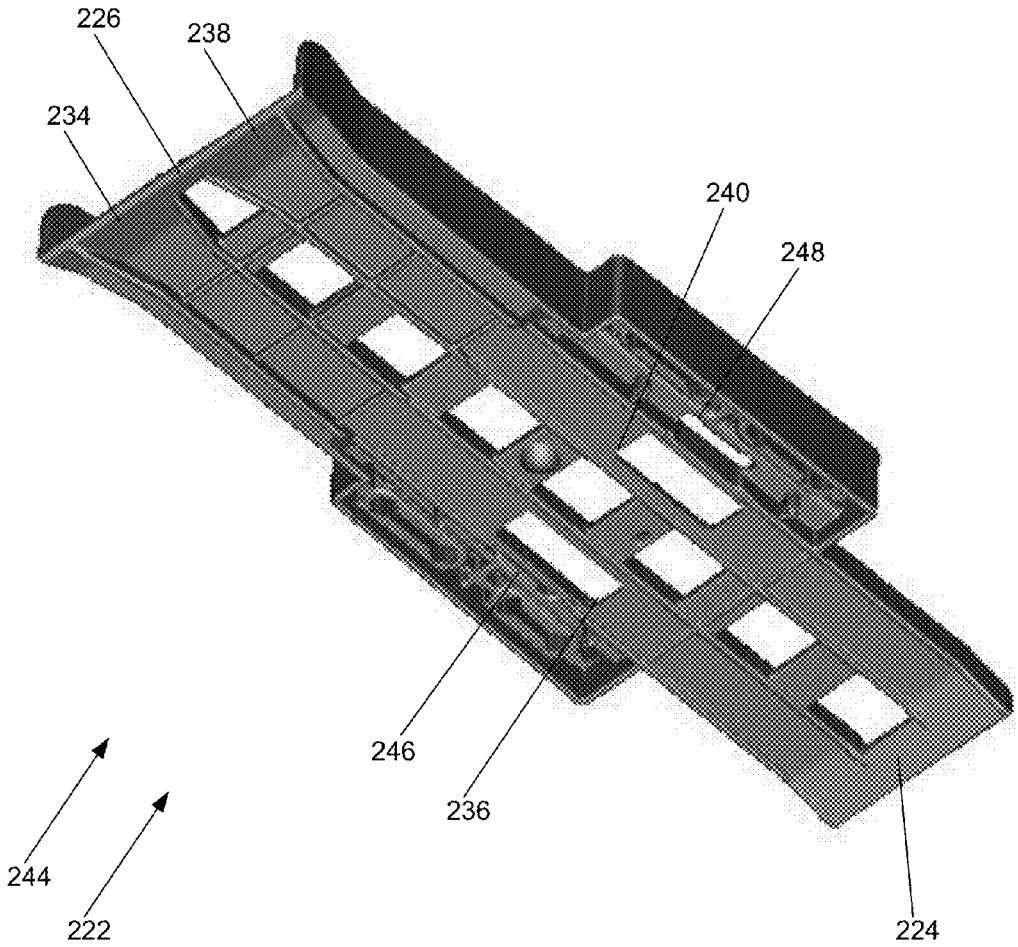
FIG. 11 illustrates a perspective view of the bottom of the track portion illustrated in FIG. 11.

As illustrated in FIGS. 8 and 10-12, the carrier 200 includes a floating track 222 that is coupled to the hanger arms 206, 210. The floating track 222 contains a first end 224 and a second end 226 disposed opposite of the first end 224. The floating track further includes a top surface 242, best illustrated in FIG. 10, and a bottom surface 244, best illustrated in FIG. 11. Disposed on the top surface 242 of the floating track 222 are a first track depression 234 and a second track depression 238. The first and second track depressions 234, 238 are spaced from one another and are parallel to one another. The first and second track depressions 234, 238 extend from the first end 224 to the second end 226 of the floating track 222. Moreover, the first and second track depressions 234, 238 are configured to receive the wheels of the toy vehicle 600, as illustrated in FIG. 1. As best illustrated in FIG. 11, disposed in the first track depression 234 between the first end 224 and the second end 226 of the floating track 222 is an opening 236. Similarly, disposed in the second track depression 238 between the first end 224 and the second end 226 of the floating track 222 is an opening 240. The openings 236, 240 extend from the top surface 242 through the floating track 222 to the bottom surface 244. The openings 236, 240 are sized and shaped to receive and retain a wheel of the toy vehicle 600.

Further disposed on the top surface 242 of the floating track 222 and extending substantially vertically are sidewalls 228 that are disposed substantially along the sides of the floating track 222 between the first end 224 and the second end 226. The sidewalls 228 contain two connector slots 230 on each side of the floating track 222, the connector slots 230 being disposed between the first end 224 and the second end 226. As best illustrated in FIG. 8, the connector slots 230 are configured to receive the ends of the hanger arms 206, 210. The ends of the hanger arms 206, 210 are received in the connector slots 230 via a friction fit, snap fit, or any other conventional means. Moreover, the sidewalls 228 contain flared ends proximate to the second end of the 226 of the floating track 222. The flared ends are flared outwardly to enable the floating track 222 to receive a toy vehicle 600 via the second end 226 of the floating track 222.

As best illustrated in FIGS. 10 and 11, the floating track 222 further includes a pair of slits 246, 248. The first slit 246 is disposed proximate to the first track depression 234, and is located between the first track depression 234 and one of the connectors slots 230. Moreover, the second slit 248 is disposed proximate to the second track depression 238, and is located between the second track depression 238 and one of the connector slots 230. The slits 246, 248 are configured to extend through the floating track 222 from the top surface 242 to the bottom surface 244.

Figure 12:
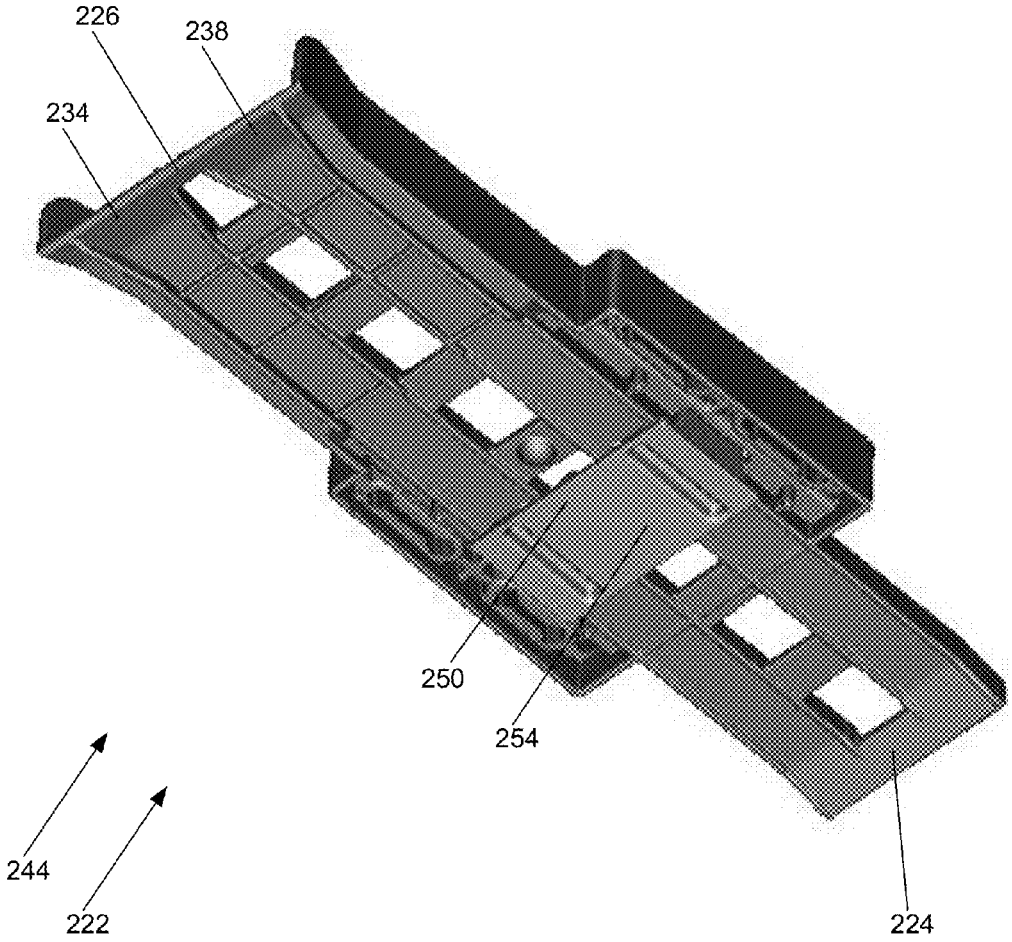
FIG. 12 illustrates a perspective view of the bottom of the track portion illustrated in FIG. 11, the track portion including the engagement member.

As best illustrated in FIGS. 10 and 12, coupled to the floating track 222 is an engagement member 250. The engagement member includes a top surface 252, best illustrated in FIG. 10, and a bottom surface 254, best illustrated in FIG. 12. The engagement member 250 includes a pair of protuberances 256 and a pair of tabs 258 that extend substantially vertically from the top surface 252 of the engagement member 250. As best illustrated in FIG. 10, the protuberances 256 are spaced from one another and are aligned with the openings 236, 240 of the first and second track depressions 234, 238. The protuberances 256 are configured to be substantially the same shape and size as the openings 236, 240. The tabs 258 are also spaced from one another such that the pair of tabs 258 are disposed on the top surface 252 of the engagement member 250 outside of the pair of protuberances 256. The tabs 258 are aligned with the slits 246, 248 of the floating track 222. The engagement member 250 is slidably coupled to the floating track 222 such that the top surface 252 of the engagement member 250 is disposed proximate to the bottom surface 244 of the floating track 222. The engagement member 250 is configured to slide toward and away from the bottom surface 244 of the floating track 222 along the length of the tabs 258. When the top surface 252 of the engagement member 250 is in abutment with the bottom surface 244 of the floating track 222, the protuberances 256 are disposed within the openings 236, 240 of the floating track 222 to fill the openings 236, 240. When the top surface 252 of the engagement member 250 is not in abutment with the bottom surface 244 of the floating track 222, the protuberances 256 are not disposed within the openings 236, 240 of the floating track 222. Moreover, when the top surface 252 of the engagement member 250 is in abutment with the bottom surface 244 of the floating track 222, the tabs 258 extend farther through the slits 246, 248 than when the top surface 252 of the engagement member 250 is not in abutment with the bottom surface 244 of the floating track 222.

Figure 13:
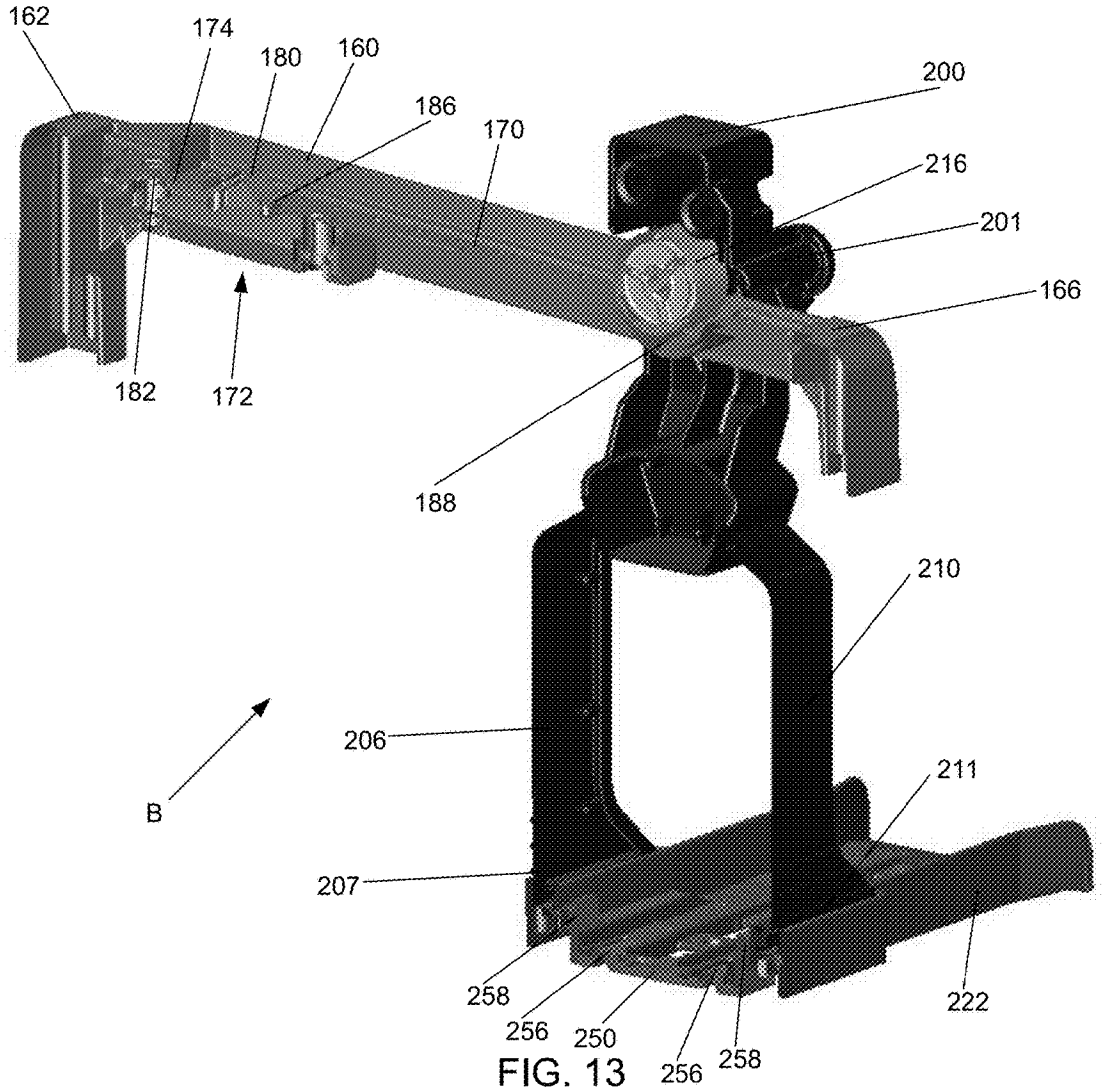
FIG. 13 illustrates a cross-sectional view of the sliding carrier illustrated in FIG. 8 being disposed along the slide rail illustrated in FIG. 6.
Figure 14:
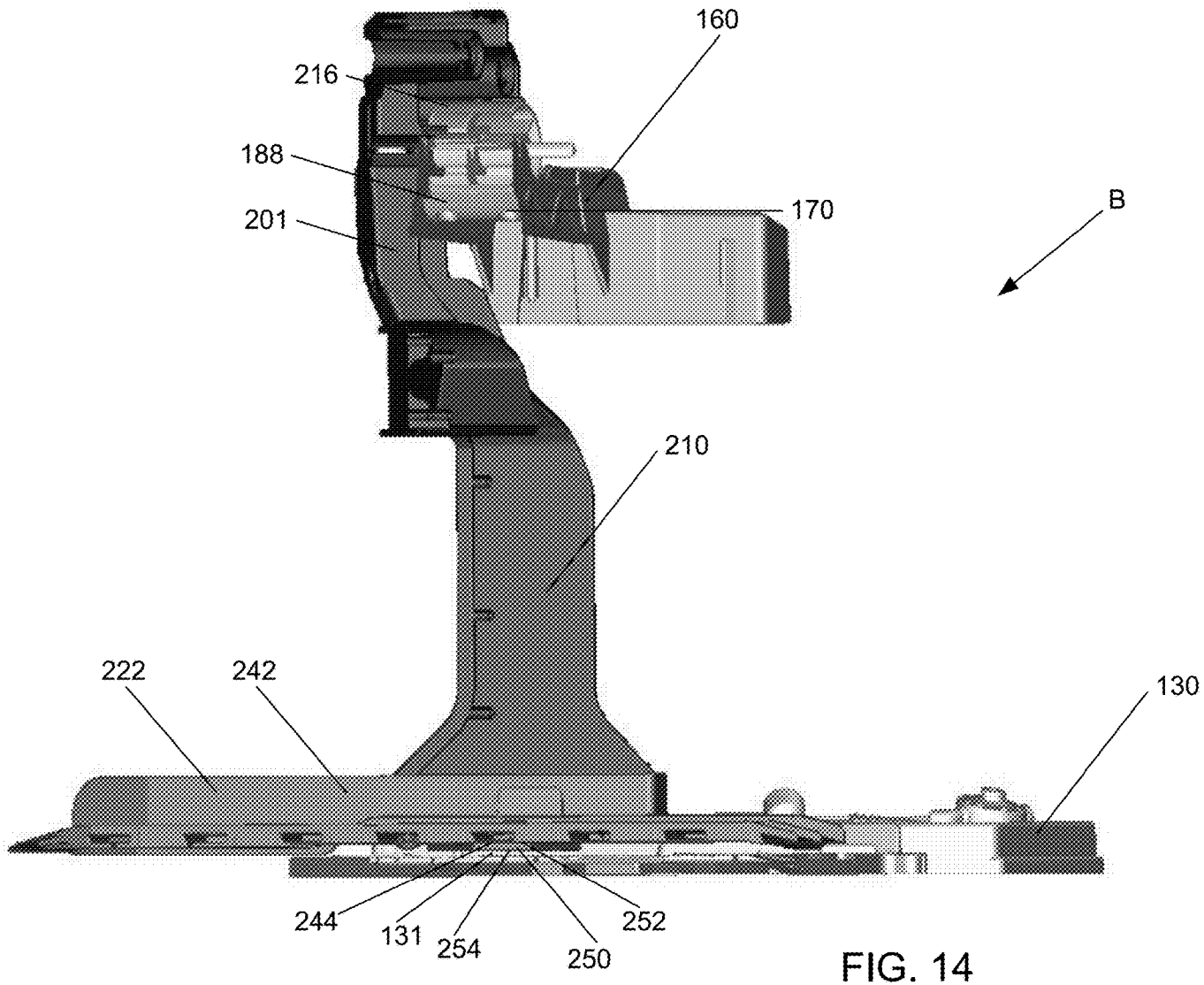
FIG. 14 illustrates a cross-sectional view of the sliding carrier illustrated in FIG. 8 being disposed on the slide rail illustrated in FIG. 6 and over a portion of the base illustrated in FIG. 4.

Turning to FIGS. 13 and 14, illustrated are views of the carrier 200 being disposed on the slide rail 160 proximate to the second end 166 of the slide rail 160. As previously explained, the carrier 200 is configured to slide along the track 170 by the wheel 216 of the carrier 200 rotating along the track 170. Furthermore, as best illustrated in FIG. 13, the wheel 216 is disposed within the cavity 188 of the track 170. The carrier 200 is configured to travel down the slide rail 160 from a first position A, as best illustrated in FIG. 1, to a second position B, as best illustrated in FIGS. 2, 3, 13, and 14. When the carrier 200 is in first position A, the carrier 200 is positioned proximate to the first end 162, where the retaining mechanism 172 retains the carrier 200 proximate to the first end 162. When the protrusion 180 of movable member 174 of the retaining mechanism 172 extends out of the opening 186, the protrusion 180 engages the wheel 216 of the carrier 200 to retain the carrier 200 in the first position A. Once a toy vehicle 600 travels onto the floating track 222, the combined weight of the toy vehicle 600 with the carrier 200 overcomes the biasing force of the resilient member 182, and the combined weight of the toy vehicle 600 with the carrier 200 pushes movable member 174 and the protrusion 180 down into and below the opening 186 in the track 170. Thus, once combination of the toy vehicle 600 and the carrier 200 overcomes the force of the resilient member 182, the carrier 200, with the toy vehicle 600 is able to travel along the track 170 of the slide rail 160 from the first end 162 towards the second end 166 via the force of gravity. As previously explained, the carrier 200 travels from the first end 162 of the slide rail 160 to the second end 166 of the slide rail 160 because the first end 162 is disposed at a first height H1 and the second end 166 is disposed at a second height H2, where the first height H1 is farther from the support surface than the second height H2. Because of the size of the cavity 188 of the track 170, once the wheel 216 of the carrier 200 reaches the cavity 188, the wheel 216 falls into the cavity 188. This stops the carrier 200 from traveling any farther along the track 170.

As best illustrated in FIG. 1, when the carrier 200 is in the first position A, the floating track 222 is disposed over the track portion 112 in the first base member 110. Furthermore, the second end of the floating track 222, which contains the flared ends 232, is positioned proximate to the ramp 116 of the track portion 112. Moreover, because of the height difference between the first end 162 and the second end 166 of the slide rail 160, the floating track 222 is disposed over the track portion 112 such that the engagement member 250 hangs below the bottom surface 244 of the floating track 222 without the top surface 252 of the engagement member 250 being in abutment with the bottom surface 244 of the floating track 222. Thus, the protuberances 256 in the engagement member 250 are not disposed in the openings 236, 240 of the floating track 222. Therefore, when the carrier 200 is in the first position A, a toy vehicle 600 traveling along the second outer track 400 will travel onto the track portion 112, up the ramp 116 and onto the floating track 222 of the carrier 200. Because the protuberances 256 of the engagement member 250 are not disposed in the openings 236, 240 of the floating track 222, the openings 236, 240 capture the wheels of the toy vehicle 600 to retain the toy vehicle on the floating track 222.

Once the toy vehicle 600 is stopped on the floating track 222, as previously explained, the combined weight of the toy vehicle 600 and the carrier 200 overcomes the biasing force of the resilient member 182, releasing the carrier 200 from the retaining mechanism 172 to travel down the slide rail 160 towards the second end 166. Once the wheel 216 of the carrier 200 has reached the cavity 188 in the track 170, the carrier 200 is stopped traveling along the slide rail 160 and is in the second position B. In repositioning from the first position A to the second position B, the carrier 200 has gone from being disposed over the first base member 110 to being disposed over the second base member 130. Moreover, the carrier 200 is positioned lower in height in the second position B than in the first position A because in the second position B, the carrier 200 is disposed proximate to the second end 166 of the slide rail 160. As previously explained, the second end 166 of the slide rail 160 is lower in height than the first end 162 of the slide rail 160. As best illustrated in FIG. 2, when the carrier 200 is in the second position B, the first end 224 of the floating track 222 is aligned with the track end 136 of the second base member 130.

As best illustrated in FIG. 14, when the carrier 200 is in the second position B, and is lower in height above the support surface, the top surface 131 of the second base member 130 is in abutment with the lower surface 254 of the engagement member 250. This causes the engagement member 250 to be pushed substantially upwardly so that the top surface 252 of the engagement member 250 is in engagement with the bottom surface 244 of the floating track 222. As previously explained, when the top surface 252 of the engagement member 250 is in engagement with the bottom surface 244 of the floating track 222, the protuberances 256 of the engagement member 250 are moved upwardly into the openings 236, 240 of the floating track 222 so that the protuberances 256 substantially fill the openings 236, 240 of the floating track 222. It then follows that when the carrier 200 is moved into the second position B, the protuberances 256 are moved into the openings 236, 240 by the top surface 131 of the second base member 130, which pushes the wheels of the toy vehicle 600 out of the openings 236, 240. The toy vehicle 600 is then able to resume traveling over the floating track 222 (via manual interaction with a user or via a drive mechanism housed within the vehicle). Because the inner track 500 is coupled to the track end 136 of the second base member 130, and because in the second position B the floating track 222 is aligned with the track end 136, the protuberances 256 pushing the wheels of the toy vehicle 600 out of the openings 236, 240 enables the toy vehicle 600 to travel off of the floating track 222 and onto the inner track 500. As illustrated in FIG. 1, the toy vehicle 600 traveling along the inner track 500 will eventually merge onto the second outer track portion 400 and continue along the second outer track portion 400 to return to the transfer station 100.

The carrier 200 must be manually returned to the first position A in order to transfer the toy vehicle again from the outer tracks 300, 400 to the inner track 500. If the carrier 200 remains in the second position B, then a toy vehicle 600 traveling on the second outer track 400 will travel onto the track portion 112, through the transfer station 100, and continue onto the first outer track portion 300. Only if the carrier 200 is in the first position A will a toy vehicle 600 traveling onto the track portion 112 of the first base member 110 from the second outer track 400 be transferred to the inner track 500.

As mentioned above, although the phrases "positive contact" and "negative contact" are used throughout this disclosure, the invention disclosed herein may be applied to either the positive contact or the negative contact without departing from the scope and spirit of the invention.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A toy vehicle playset comprising:

a support frame extending substantially upward from a support surface;

a slide rail coupled to the support frame, the slide rail having a first end at a first height and a second end at a second height with respect to the support surface, the first height being greater than the second height;

a carrier including a toy vehicle track section, the carrier being translatably coupled to the slide rail and configured to move substantially laterally along the slide rail from a first position proximate the first end of the slide rail to a second position proximate the second end of the slide rail; and a retaining mechanism disposed on the slide rail proximate the first end, the retaining mechanism being configured to retain the carrier in the first position, wherein a toy vehicle disposed on the track section of the carrier deactivates the retaining mechanism allowing the carrier to travel along the slide rail to the second position.

2. The toy vehicle playset of claim 1, wherein the support frame is disposed proximate to a first toy vehicle track and a second toy vehicle track.

3. The toy vehicle playset of claim 2, wherein the carrier is disposed proximate to the first track when in the first position and is disposed proximate to the second track when in the second position.

4. The toy vehicle playset of claim 3, wherein the track section of the carrier is configured to receive the toy vehicle from the first track when the carrier is in the first position and is configured to release the toy vehicle to the second track when the carrier is in the second position.

5. The toy vehicle playset of claim 1, wherein the track section of the carrier contains at least one opening sized and shaped to receive and retain a wheel of the toy vehicle.

6. The toy vehicle playset of claim 5, further comprising an engagement member movably coupled to the track section of the carrier, the engagement member including at least one protrusion aligned with the at least one opening of the track section of the carrier.

7. The toy vehicle playset of claim 6, wherein the engagement member is configured to move with respect to the track section of the carrier, the at least one protrusion of the engagement member being disposed out of the at least one opening of the track section of the carrier when the carrier is in the first position, and the at least one protrusion of the engagement member being disposed in the at least one opening of the track section of the carrier when the carrier is in the second position, the at least one protrusion being disposed in the at least one opening preventing the at least one opening from receiving and retaining the wheel of the toy vehicle.

8. A toy vehicle playset comprising:

a support frame extending upwardly from a support surface;

a slide rail disposed on the support frame, the slide rail having a first end at a first height and a second end at a second height with respect to the support surface, the first height being greater than the second height;

a carrier including a toy vehicle track section, the carrier being moveably coupled to the slide rail and configured to translate along the slide rail between a first position and a second position, the carrier, in the first position, being disposed proximate the first end of the slide rail, and the carrier, in the second position, being disposed proximate to the second end of the slide rail; and a retaining mechanism disposed on the slide rail and configured to prevent the carrier from translating down the slide rail, wherein when the carrier receives a toy vehicle on the track section of the carrier, a weight of the carrier combined with a weight of the toy vehicle causes the retaining mechanism to release the carrier enabling the carrier to translate along the slide rail to the second position.

9. The toy vehicle playset of claim 8, wherein the retaining mechanism includes a movable member having a protrusion, the movable member moving between a retaining position and an open position, the protrusion of the movable member preventing the carrier from translating down the slide rail when the movable member is in the retaining position.

10. The toy vehicle playset of claim 9, wherein the slide rail includes a track, and the protrusion of the movable member is configured to extend into the track of the slide rail when the movable member is in the retaining position.

11. The toy vehicle playset of claim 9, wherein the retaining mechanism further includes a resilient member coupled to the movable member and configured to impart a biasing force onto the movable member to bias the movable member into the retaining position.

12. The toy vehicle playset of claim 11, wherein the weight of the carrier combined with the weight of the toy vehicle overcomes the biasing force of the resilient member, repositioning the movable member from the retaining position to the open position.

13. The toy vehicle playset of claim 10, wherein the carrier includes a wheel configured for receipt by the track of the slide rail, wherein rotation of the wheel along the track of the slide rail translates the carrier along the slide rail.

14. The toy vehicle playset of claim 13, wherein the track of the slide rail includes a cavity disposed on the track proximate to the second end of the slide rail, the cavity being sized and shaped to capture the wheel of the carrier, stopping the movement of the carrier in the second position.

15. A toy vehicle playset comprising:

a support frame extending substantially upwardly from a support surface;

a slide rail including a first end and a second end, the slide rail being disposed on the support frame at an angle offset from a horizontal axis where the first end is oriented farther above the support surface than the second end;

a carrier including a platform coupled to the bottom of the carrier, the carrier being movably coupled to the slide rail and configured to substantially laterally translate along the slide rail between a first position and a second position, the carrier in the first position being disposed on the slide rail proximate the first end and the carrier in the second position being disposed on the slide rail proximate to the second end; and a retaining mechanism disposed on the slide rail, the retaining mechanism comprising:

a retaining arm repositionable between a retaining position and an open position, the retaining arm in the retaining position being configured to retain the carrier in the first position, and a resilient member coupled to the retaining arm and imparting a biasing force to the retaining arm to bias the retaining arm in the retaining position, wherein when the carrier receives a toy vehicle on the platform, a weight of the carrier combined with a weight of the toy vehicle overcomes the biasing force of the resilient member, moving the retaining arm to the open position to enable the carrier to move along the slide rail to the second position.

16. The toy vehicle playset of claim 15, wherein the slide rail includes a track that extends from the first end to the second end.

17. The toy vehicle playset of claim 16, wherein the retaining arm further includes a protrusion that extends into the track of the slide rail when the retaining arm is in the retaining position.

18. The toy vehicle playset of claim 17, wherein the carrier includes a wheel to rotate along the track of the slide rail, the protrusion of the retaining mechanism being configured to engage the wheel when the retaining arm is in the retaining position to prevent the wheel from rotating along the track.

19. The toy vehicle playset of claim 15, wherein the support frame is disposed proximate to a first toy vehicle track and a second toy vehicle track, the platform of the carrier being disposed over and in alignment with the first track when the carrier is in the first position and the platform of the carrier being disposed in alignment with the second track when in the second position.

20. The toy vehicle playset of claim 19, wherein the carrier is configured to receive the toy vehicle from the first track when the carrier is in the first position and is configured to release the toy vehicle onto the second track when the carrier is in the second position.

* * * * *